US006354848B1

(12) United States Patent
Billman et al.

(10) Patent No.: US 6,354,848 B1
(45) Date of Patent: Mar. 12, 2002

(54) CLAMP-TYPE ADAPTER FOR CONNECTING A MEMORY MODULE TO A CARD EDGE CONNECTOR

(75) Inventors: Timothy Brian Billman, Dover, PA (US); Gene Whetstone, Corona, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/661,180

(22) Filed: Sep. 13, 2000

(51) Int. Cl.[7] ..... H01R 12/20
(52) U.S. Cl. ..... 439/79; 439/596; 439/638
(58) Field of Search ..... 439/79, 596, 638

(56) References Cited

U.S. PATENT DOCUMENTS 5,584,708 A * 12/1996 Leong ..... 439/70
5,709,555 A * 1/1998 Noschese ..... 439/79
5,813,877 A * 9/1998 Nakamura ..... 439/596
6,071,150 A * 6/2000 Tang et al. ..... 439/638

* cited by examiner

*Primary Examiner*—Gary F. Paumen
*Assistant Examiner*—James R. Harvey
(74) *Attorney, Agent, or Firm*—Wei Te Chung

(57) ABSTRACT

A clamp-type adapter (1) for a memory module (2) includes two adapter halves (10), (10') with similar structures for snapping over a lower portion (20) of the memory module, which has a plurality of conductive pads (22), (22') on opposite surfaces thereof. Each adapter half includes an elongate housing (12), a row of alternating outer conductive contacts (14) and inner conductive contacts (14') interposed with grounding blades (13), and a shield (16) covering the housing. The contacts and the grounding blades are insert molded in the housing. The housing comprises an inner portion (121) and an outer portion (122). Each outer/inner contact comprises a contact portion (142)/(142') and a tail portion (146)/(146'). The contact portion is exposed to the outside from a bottom surface of the inner portion for engaging with a corresponding contact of the card edge connector. The tail portion extends out from a top surface of the outer portion for contacting a corresponding pad of the memory module. The adapter substitutes direct connection of a memory module to a card edge connector, which connection frequently results in damage to the module's conductive pads after repeated connection/disconnection cycles.

1 Claim, 7 Drawing Sheets

CLAMP-TYPE ADAPTER FOR CONNECTING A MEMORY MODULE TO A CARD EDGE CONNECTOR

FIELD OF THE INVENTION

The present invention relates to a clamp-type adapter for connecting a card device to a connector, and particularly to a clamp-type adapter for connecting a memory module to a card edge connector without damaging the conductive pads arranged along an edge of the memory module.

BACKGROUND OF THE INVENTION

A variety of card edge connectors have been developed for use in computers to connect memory modules to mother boards of the computers. Such connectors are disclosed in Taiwan Patent Application Nos. 83213192 and 84202235. Referring to FIG. 7, a conventional card edge connector 5 is mounted upright on a printed circuit board (PCB) 7. A memory module 6 is to be connected to the card edge connector 5. The connector 5 comprises an elongate housing 52 which defines a central slot 522 therein. A plurality of conductive terminals 54 are disposed along opposite side walls of the housing 5 beside the slot 522. The memory module 6 consists of a printed circuit board 65 and a plurality of memory devices (not shown) mounted on the board 65. Two rows of conductive pads 62 are formed on opposite surfaces of a lower edge 64 of the printed circuit board 65 to electrically contact with corresponding terminals 52 of the connector 5.

However, the conductive pads 62 are much thinner than the terminals 54 of the card edge connector 5. When a memory module 6 is repeatedly inserted into and withdraw from a card edge connector 5, inferential rubbing of the conductive pads 62 across the surfaces of the terminals 54 causes the conductive pads 62 to peel away from the memory module 6.

Hence, a means is required to interconnect a memory module to a card edge connector which overcomes the disadvantages of the prior art.

BRIEF SUMMARY OF THE INVENTION

A main object of the present invention is to provide a means whereby the fragile conductive pads of a memory module are protected from damage by the terminals of a mating card edge connector, partially under conditions of repeated insertion and withdrawl of the memory module.

To fulfill the above-mentioned object, according to one embodiment of the present invention, a clamp-type adapter connects between a memory module and a card edge connector mounted on a printed circuit board. The clamp-type adapter comprises two adapter halves which snap over a lower portion of the memory module, to form a plurality of sturdy conductive pads on opposite surfaces of the lower portion of the memory module. The two adapter halves have similar structures. Each adapter half comprises an elongate housing, a row of outer conductive contacts and inner conductive contacts, and a shield on the housing. Each outer contact alternates with an adjacent inner contact and both are insert molded in the housing by conventional means. The housing comprises an inner portion, and an outer portion extending outward and downward from the inner portion. Each outer or inner contact comprises a contact portion, a retaining portion extending from the contact portion and insert molded in the housing and a tail portion extending from the retaining portion for contacting a corresponding pad of the memory module. The contact portion is exposed to the outside from a bottom surface of the inner portion, for contacting a corresponding contact of the card edge connector.

Other objects, advantages and novel features of the invention will become more apparent from the following detailed description of the present embodiment when taken in conjunction with the accompanying drawings.

DETAILED DESCRIPTION OF THE INVENTION

Figure 1:
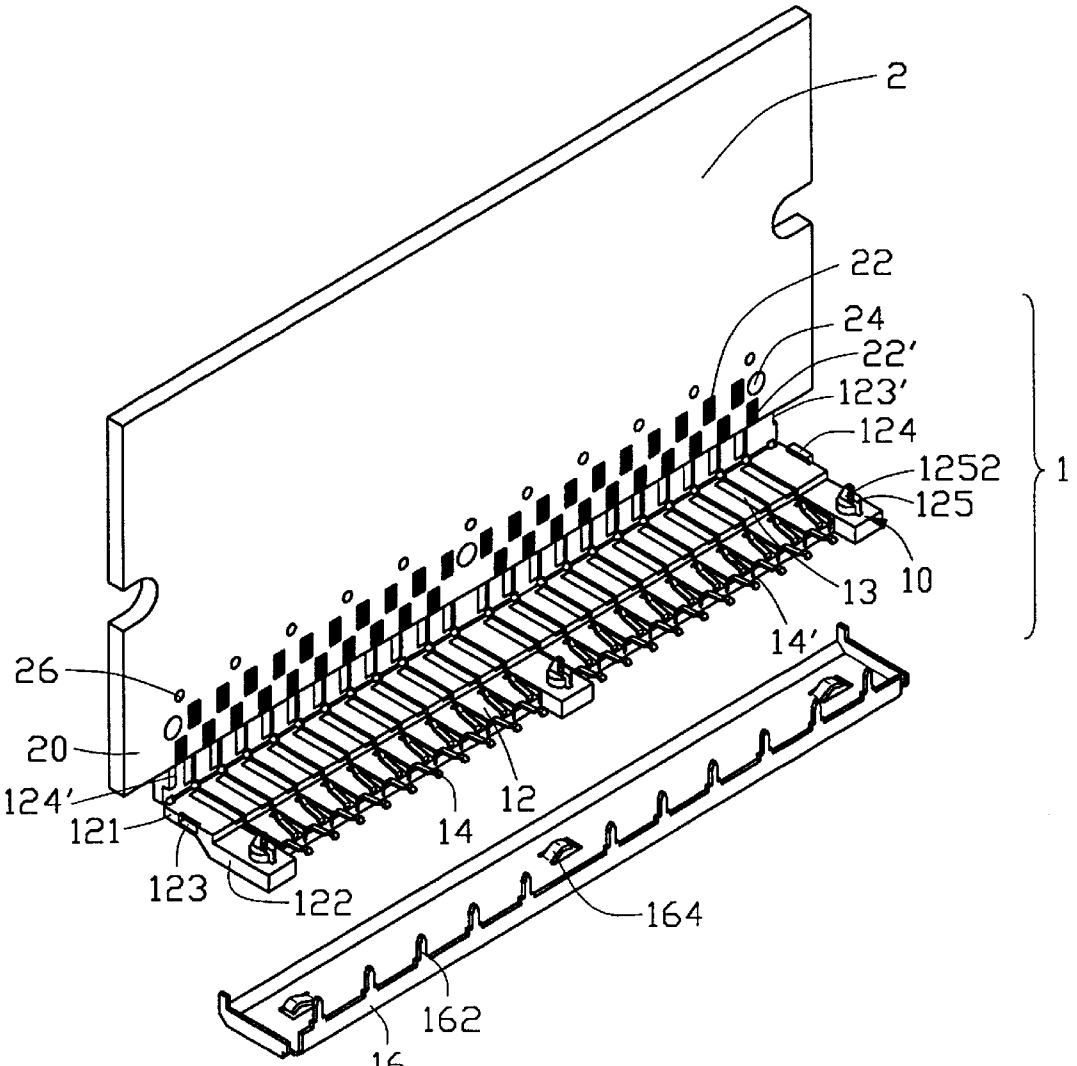
FIG. 1 is an exploded perspective view of a memory module and a clamp-type adapter in accordance with a first embodiment of the present invention, wherein the clamp-type adapter is only partially assembled to the module.
Figure 2:
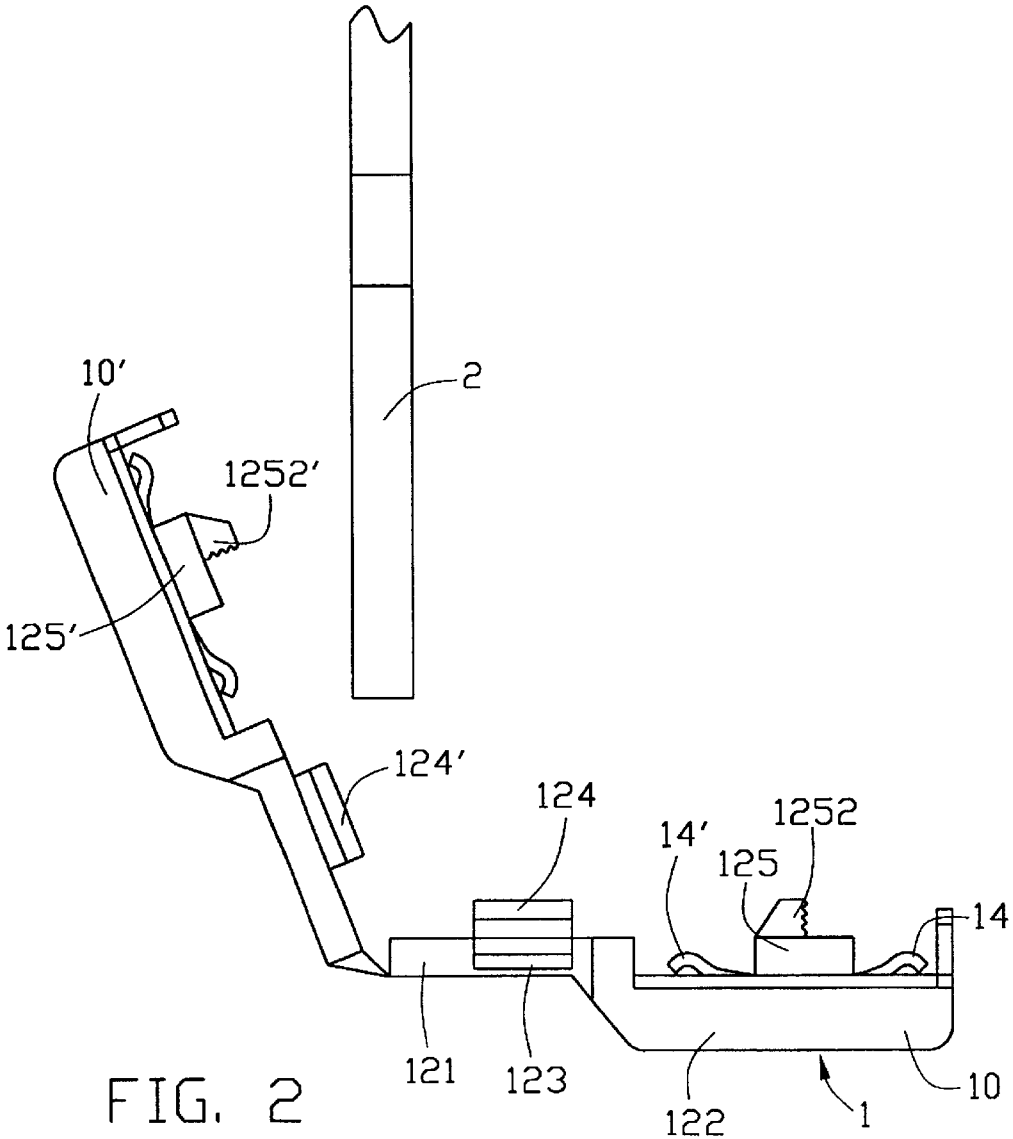
FIG. 2 is an enlarged side view of the clamp-type adapter and memory module of FIG. 1.

Referring to FIGS. 1 and 2, a clamp-type adapter 1 in accordance with a first embodiment of the present invention is used for connecting a memory module 2 with a card edge connector, such as a DIMM connector or a RIMM connector (not shown). The memory module 2 is conventional and could be the one shown in FIG. 1. A lower portion 20 of the memory module 2 forms a row of upper pads 22 and a row of lower pads 22' on each outer surface thereof, and defines three through holes 24 through opposite lateral sides and a middle portion thereof, respectively.

Referring to FIGS. 1 and 2, the adapter 1 comprises two adapter halves 10, 10' foldable along adjacent edges thereof for securely mating with a lower portion 20 of the memory module 2. The two adapter halves 10, 10' have a similar structure, so only the adapter half 10 is described in detail herein. The adapter half 10 comprises an elongate insulative housing 12, a row of outer and a row of inner conductive contacts 14, 14', and a shield 16 covering on an outer surface of the housing 12.

Figure 4A:
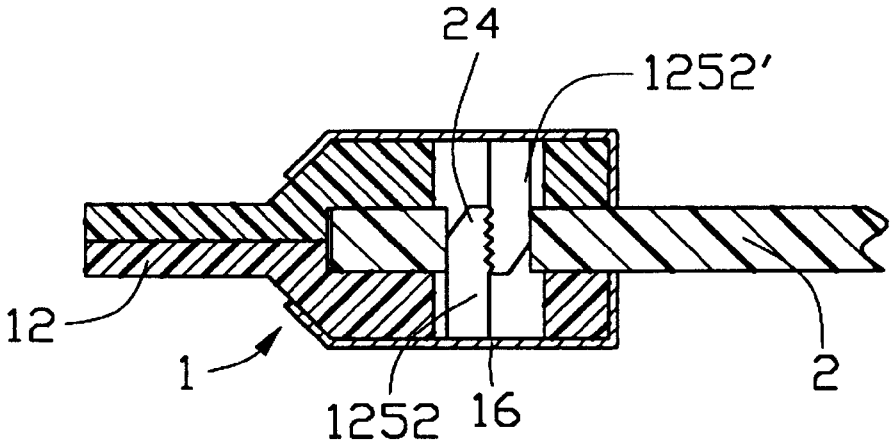
FIG. 4A is a cross-sectional view taken along line 4A—4A of FIG. 3.

The housing 12 forms an inner portion 121, and an outer portion 122 extending outward and downward from the inner portion 121. A recess 123 and a latch 124 are defined in opposite lateral sides of the inner portion 121 to respectively engage with a latch 124' and a recess 123' formed on the adapter half 10'. Three latching members 125 are formed on the outer portion 122, for partially latching into corresponding through holes 24 in the memory module 2. A half-pincer 1252 projects perpendicularly from each latching member 125 for engaging with a corresponding half-pincer 1252' complementarily formed on a corresponding latching member 125' of the adapter half 10'. The half-pincers 1252, 1252' together form an entire pincer to connecting the two adapter halves 10, 10' to the memory module 2 (FIG. 4A).

Figure 3:
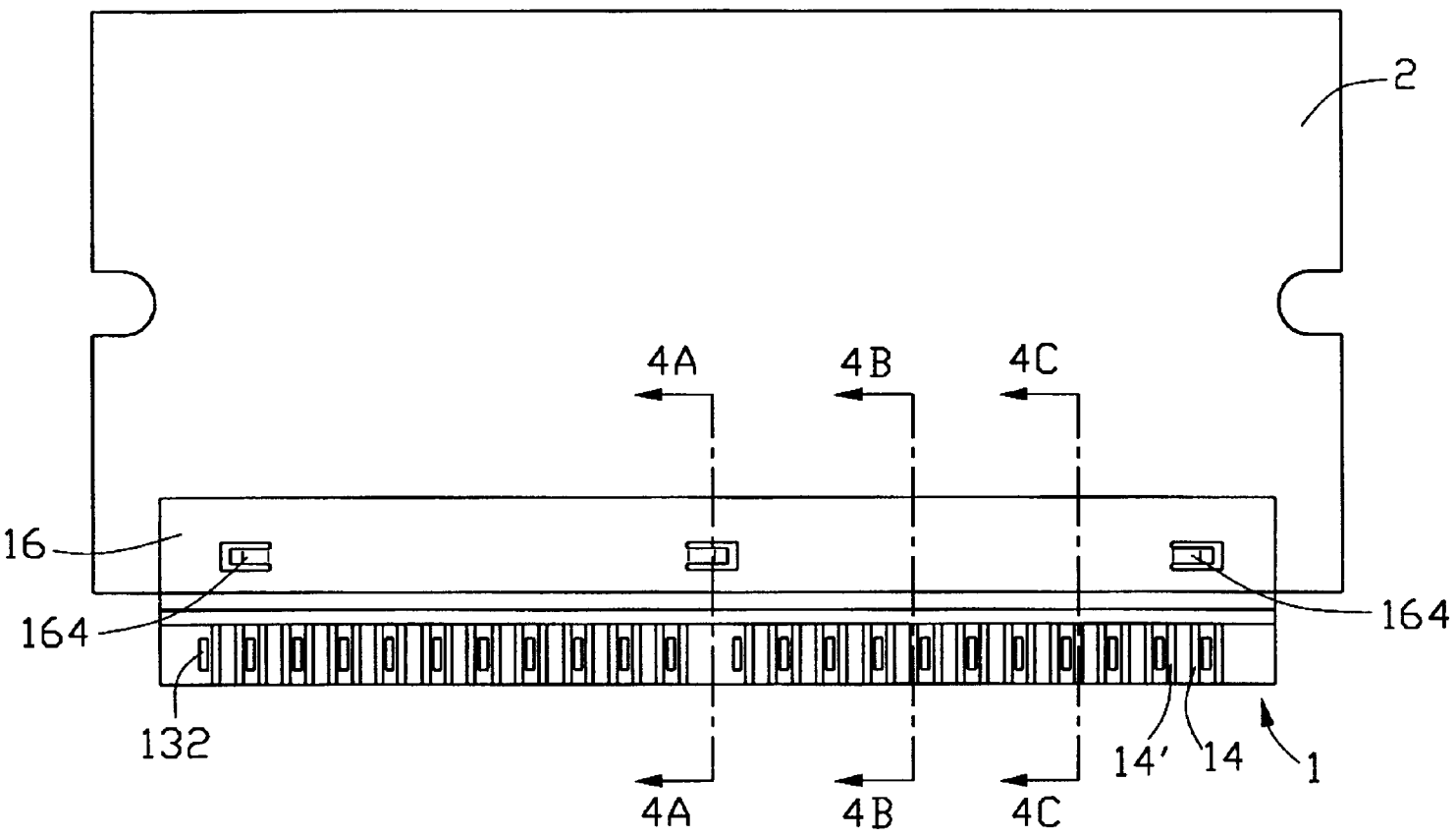
FIG. 3 is a planar front view of FIG. 1, with the clamp-type adapter completely engaged with the memory module.

Each outer contact 14 alternates with an inner contact 14' along a longitudinal direction of the housing 12. A grounding blade 13 is interposed generally between each of an associated combination of an outer contact 14 and an inner contact 14'. A contact portion 132 (see FIGS. 3, 5) of each grounding blade 13 extends to a bottom surface 1212 (see FIG. 4B) of the inner portion 121 and is exposed to the outside for contacting a mating grounding terminal of the card edge connector ( not shown).

Figure 4B:
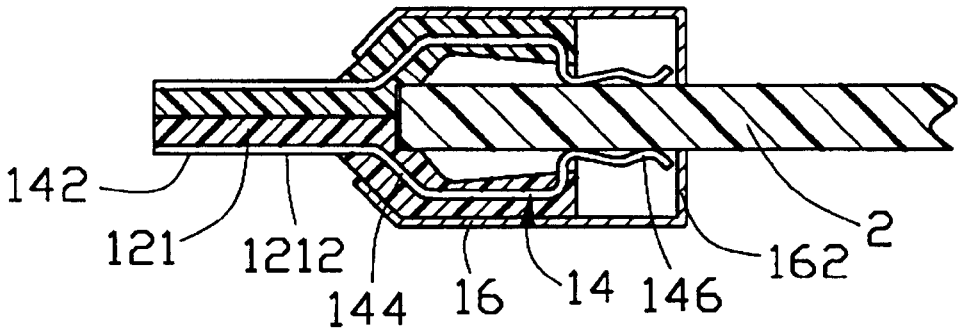
FIG. 4B is a cross-sectional view taken along line 4B—4B of FIG. 3.
Figure 5:
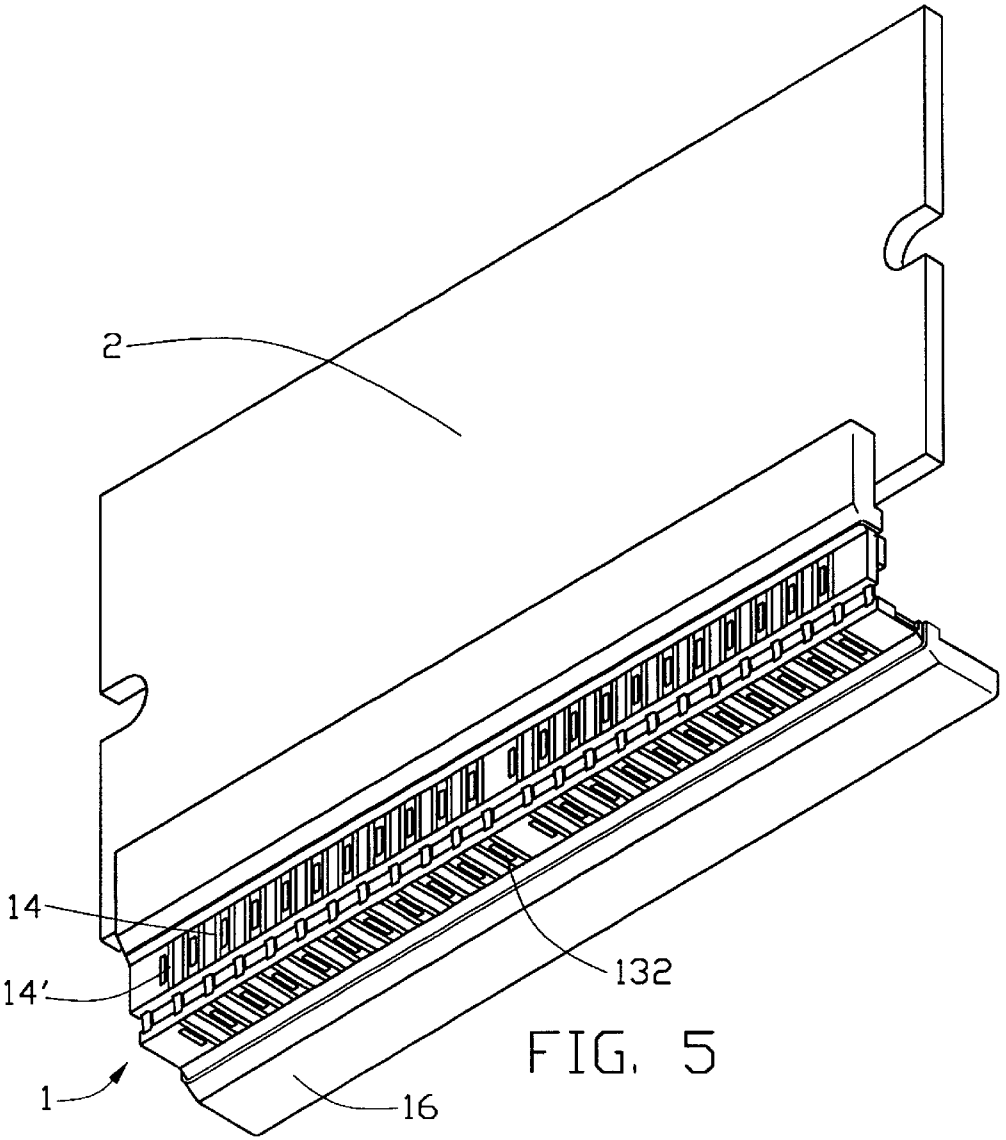
FIG. 5 is a perspective view of FIG. 1 taken from a different angle with the adapter now fully assembled.

Referring to FIG. 4B, each outer contact 14 comprises a contact portion 142 received in a corresponding slit (not labeled) defined in the bottom surface 1212 of the inner portion 121 and is exposed to the outside for contacting a corresponding terminal of the card edge connector (not shown). A retaining portion 144 of each outer contact 14 extends outward and downward from the contact portion 142 and is insert molded in the housing 12 by conventional means. A tail portion 146 further extends upward and outward from the retaining portion 144 for contacting a corresponding upper pad 22 of the memory module 2.

Figure 4C:
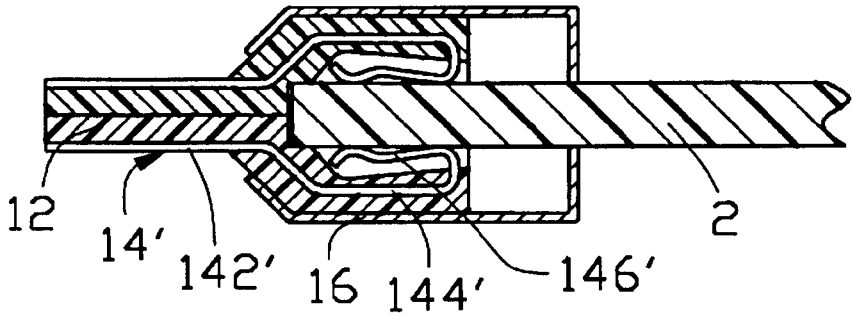
FIG. 4C is a cross-sectional view taken along line 4C—4C of FIG. 3.

Referring to FIG. 4C, each of the inner contacts 14' comprises a contact portion 142' and a retaining portion 144', both of which have similar structures to the contact portion 142 and retaining portion 144 of the outer contact 14, respectively. However, a tail portion 146' of the inner contact 14' extends upward and backward from the retaining portion 144', for contacting a corresponding lower pad 22' of the memory module 2.

The shield 16 covers a bottom surface (not labeled) of the outer portion 122 and forms a plurality of tabs 164 abutting against the bottom surface of the outer portion 122 of the housing 12 for securing the shield 16 to the housing 12. A series of pins 162 project perpendicularly from an outer edge of the shield 16 for interferentially inserting into corresponding holes 26 defined above and adjacent the upper pads 22 of the memory module 2.

In assembly, referring to FIGS. 1 through 5, the outer and inner contacts 14, 14' are alternately insert molded into the housings 12. Tare he grounding blades 13 interposed with the outer and inner contacts 14, 14' and also insert molded into the housing 12. The shield 16 is clipped onto the bottom surface of the outer portion 122, with the tabs 164 thereof abutting against the housing 12. The two adapter halves 10, 10' are folded over the lower portion 20 of the memory module 2 with the pins 162 of the shield 16 interferentially inserted into corresponding holes 26 of the memory module 2. The outer and inner contacts 14, 14' electrically contact with the upper and lower pads 22, 22' of the memory module 2, respectively. The recess 123 and the latch 124 of the adapter half 10 engage with the latch 124' and recess 123' of the adapter half 10', respectively. The latching members 125, 125' are received in the corresponding through holes 24 in the memory module 2, with the halves of half-pincers 1252, 1252' locking with each other, thereby securely connecting the adapter 1 to the memory module 2. Finally, the lower portions 121, 121' of the adapter halves 10, 10' are inserted into the card edge connector. The contact portions 142/142' of the contacts 14/14' and the contact portions 132 of the grounding blades 13 electrically contact with respective contacts and grounding terminals of the card edge connector (not shown), respectively, thereby making an indirect electrical connection between the memory module 2 and the card edge connector.

Figure 6:
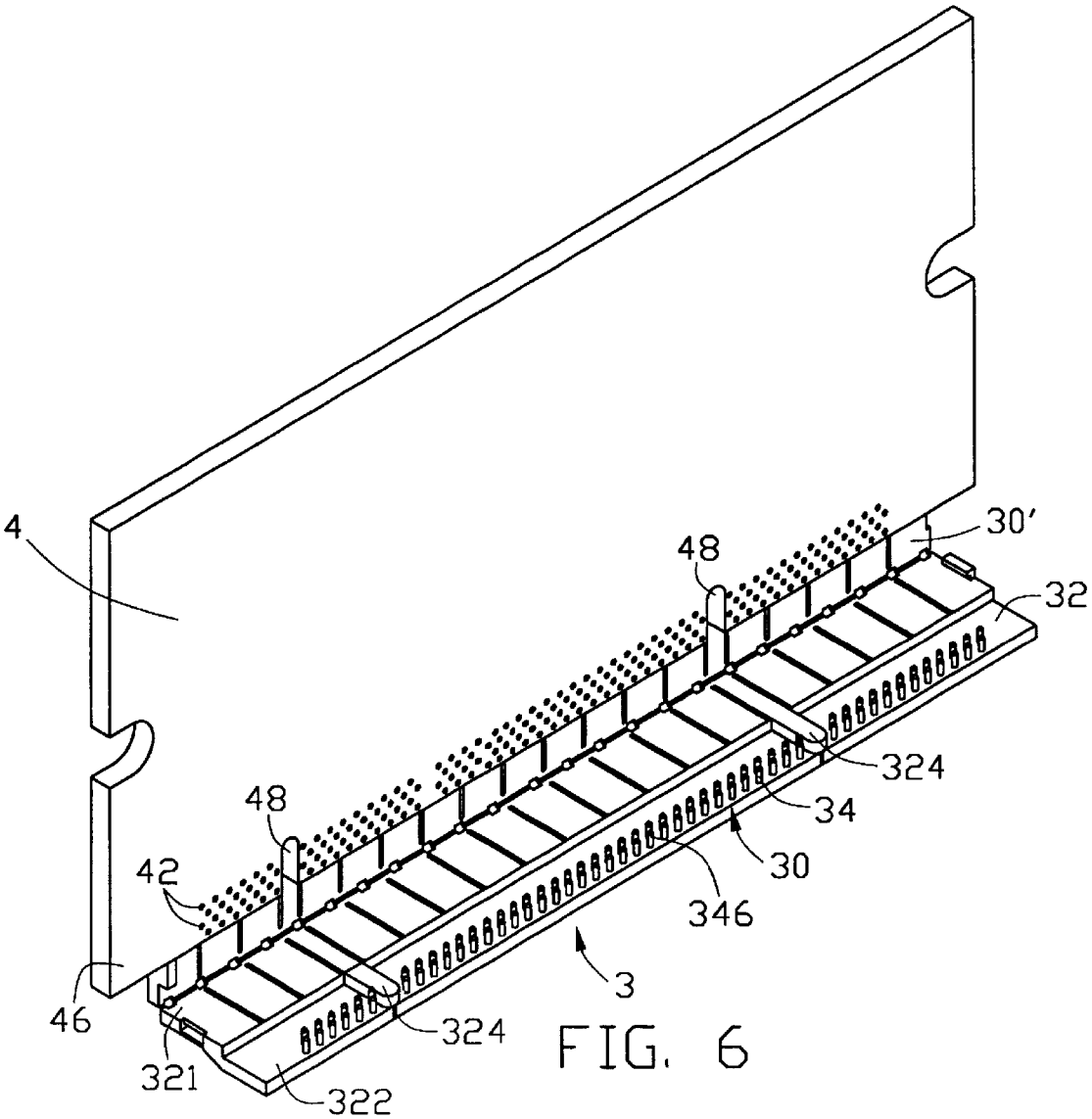
FIG. 6 is a perspective view of a memory module and a clamp-type adapter in accordance with a second embodiment of the present invention.
Figure 7:
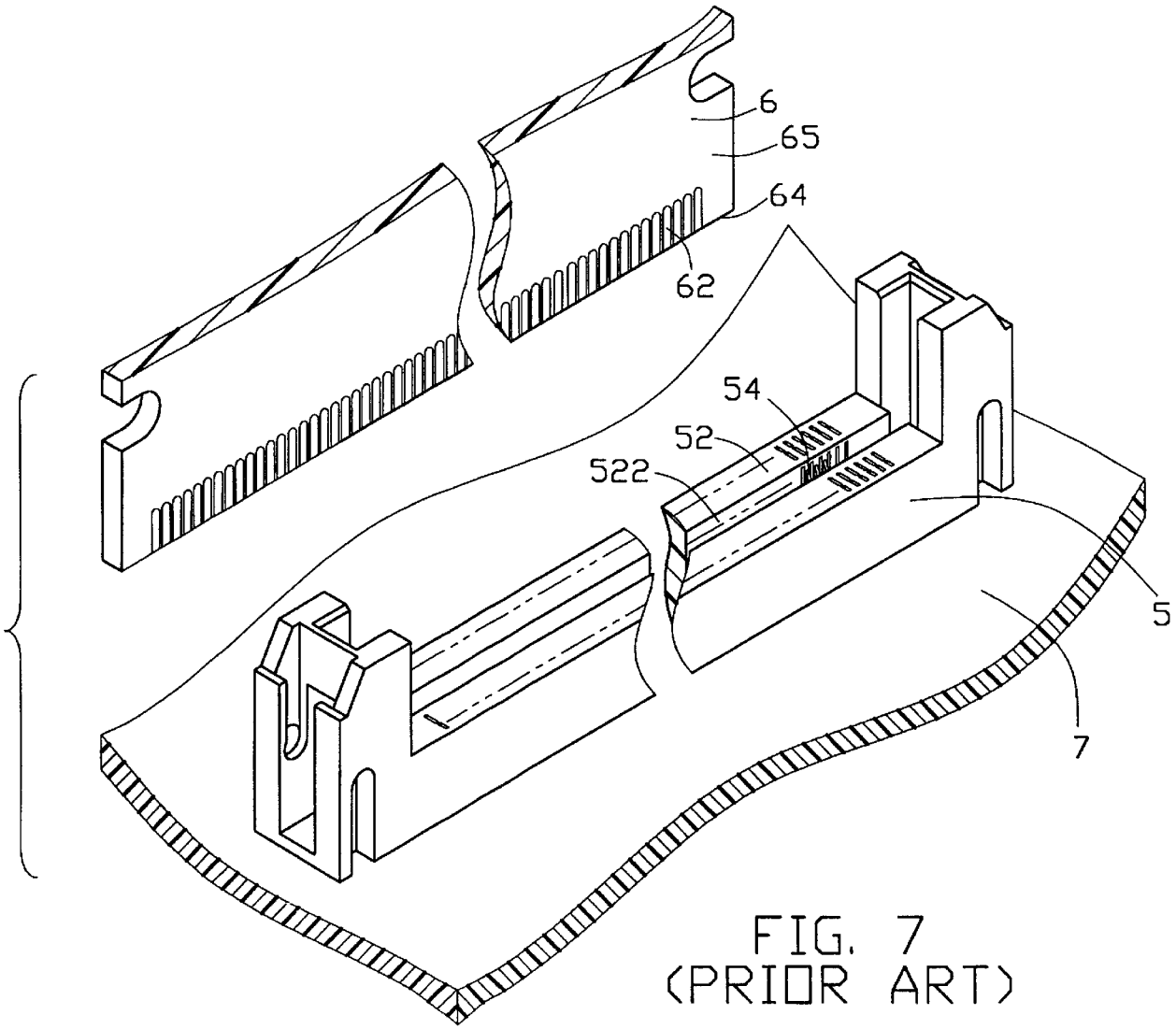
FIG. 7 (PRIOR ART)
FIG. 7 is a perspective view of a prior art card edge connector, a memory module and a printed circuit board prior to insertion of the memory module into the card edge connector.

Referring to FIG. 6, a second embodiment of the present invention is illustrated to emulate the pads 22, 22' of the memory module 2 but without the problems usually associated with the pads. This connector system comprises a memory module 4 and an electrical adapter 3 clipped to the memory module 4. A lower portion 46 of the memory module 4 defines an array of holes 42. A pair of slots 48 is defined in the lower portion 46 and extends toward an opposite upper portion of the memory module 4.

The adapter 3 is similar in structure to the adapter 2 of the first embodiment except that the adapter 3 is not provided with a conductive shield and a plurality of grounding blades, as was described for the first embodiment. Thus, only those structures which differ from the adapter 2 are described below.

The adapter 3 comprises two adapter halves 30, 30' which fold over the lower portion 46 of the memory module 4. The two adapter halves 30, 30' have a similar structure. Thus, only the adapter half 30 described in detail herein.

The adapter half 30 comprises an elongate housing 32 and a row of alternating upper and lower contacts 34 insert molded in the housing 32 by conventional means.

The elongate housing 32 comprises an inner portion 321 and an outer portion 322 extending outward and downward from the inner portion 321. A pair of positioning projections 324 extend perpendicularly from a top surface (not labeled) of the outer portion 322 at locations corresponding to the slots 48 of the memory module 4. The projections 324 are sized to interferingly fit into the slots 48.

Each upper/lower contact 34 is similar in function to each outer/inner contact 14/14' of the adapter 2 of the first embodiment of the invention. Specially, each upper and lower contact 34 comprises a contact portion (not shown) and a retaining portion (not shown) identical to the contact portion 142, 142' and retaining portions 144, 144, of the first embodiment. A tail portion 346 of the upper/lower contact 34 extends perpendicularly from the retaining portion of the upper/lower contacts 34 for insertion into a corresponding hole 42 of the memory module 4. Consequently, an electrical connection between each contact 34 and a corresponding hole 42 replaces the electrical connection between each contact 14/14' and a corresponding pad 22/22' of the first embodiment, thus, providing an effective and secure connection therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A clamp-type adapter for connecting a memory module to a card edge connector, comprising:

a dielectric housing having two adapter halves similar in structure and foldable along adjacent edges for securely mating with a lower portion of the memory module; and a row of conductive contacts arranged along a longitudinal direction of each adapter half, each contact comprising a contact portion for electrically contacting with a mating contact of the card edge connector and a tail portion for contacting with a corresponding conductive pad formed on the lower portion of the memory module;

wherein each of the adapter halves comprises an inner portion near the adjacent edges and an outer portion extending outwardly and upwardly from the inner portion;

wherein a conductive shield covers a bottom surface of each outer portion and forms a plurality of pins insertable into a plurality of holes of the memory module defined adjacent to the conductive pads thereof, wherein the inner portion of each adapter half forms a latch and a recess at opposite ends thereof, for latchably engaging with, respectively, the recess and the latch of the other adapter half, wherein each outer portion of the housing forms a plurality of latching members along an outer end thereof for insertion into through holes defines in the memory module;

wherein the conductive contacts comprise inner contacts and outer contacts, and said inner and outer contacts are arranged in an alternating arrangement;

wherein a plurality of grounding blades are interposed among the alternating inner and outer contacts;

wherein the contact portions of the inner and outer contacts are exposed at bottom surfaces of the respective inner portion of the housing;

wherein each inner and outer contact forms a retaining portion between the contact portion and the tail portion thereof, and said retaining portion is insert molded into the respective outer portion of the housing;

wherein the tail portion of each outer contact extends outwardly from the retaining portion for contacting a conductive pad in an upper row of the plurality of conductive pads of the memory module and the tail portion of each inner contact bends backwardly and parallel to the retaining portion for contacting a conductive pad in a lower row of the plurality of conductive pads of the memory module.

* * * * *